US006082212A

United States Patent [19]

Bergman et al.

[11] Patent Number: 6,082,212

[45] Date of Patent: Jul. 4, 2000

[54] MULTI-FUNCTION CONTROL HANDLE

[75] Inventors: Brent A. Bergman, Yorkshire; Allen T. Trego, New Bremen, both of Ohio

[73] Assignee: Crown Equipment Corporation, New Bremen, Ohio

[21] Appl. No.: 09/119,100

[22] Filed: Jul. 20, 1998

Related U.S. Application Data

[60] Provisional application No. 60/053,722, Jul. 25, 1997, provisional application No. 60/053,739, Jul. 25, 1997, and provisional application No. 60/060,288, Sep. 29, 1997.

[51] Int. Cl.[7] ..... G05G 9/047; G05G 5/03

[52] U.S. Cl. ..... 74/471 XY; 527/569

[58] Field of Search ..... 74/471 XY, 527, 74/569; 200/6 A

[56] References Cited

U.S. PATENT DOCUMENTS

| | | |
|---|---|---|
| 4,306,208 | 12/1981 | Coors . |
| 4,352,050 | 9/1982 | Sakano . |
| 4,353,177 | 10/1982 | Hoekstra . |
| 4,375,631 | 3/1983 | Goldberg . |
| 4,489,304 | 12/1984 | Hayes . |
| 4,490,710 | 12/1984 | Kopsho, Jr. et al. . |
| 4,520,242 | 5/1985 | Kopsho, Jr. . |
| 4,533,899 | 8/1985 | Isaksson . |
| 4,587,510 | 5/1986 | Kim . |
| 4,620,176 | 10/1986 | Hayes . |
| 4,646,087 | 2/1987 | Schumann . |
| 4,646,582 | 3/1987 | Kijima . |
| 4,733,214 | 3/1988 | Andresen . |
| 4,784,008 | 11/1988 | Paquereau et al. . |
| 4,795,952 | 1/1989 | Brandstetter . |
| 4,849,583 | 7/1989 | Meyer . |
| 4,912,997 | 4/1990 | Malcolm et al. . |
| 5,176,041 | 1/1993 | Meier et al. . |
| 5,257,992 | 11/1993 | Estrada et al. . |

FOREIGN PATENT DOCUMENTS

| | | |
|---|---|---|
| 0 459 183 A1 | 12/1991 | European Pat. Off. . |
| 3117414 C2 | 12/1984 | Germany . |
| 631 818 | 8/1982 | Switzerland . |

*Primary Examiner*—Allan D. Herrmann
*Attorney, Agent, or Firm*—King and Schickli, PLLC

[57] ABSTRACT

A handle mounted generally horizontally on a fork lift truck for controlling forward and reverse speed of movement of the truck and raising and lowering forks is carried by a control device. The control device includes a shaft with a centrally positioned spherical section contained in a socket in a support member. The shaft is therefore free to rotate about the center of the sphere. A ramp cam is mounted on the support member surrounding the shaft. A slider mounted on the shaft is pressed against the cam by action of a spring. This arrangement assures that the shaft and control handle remain centered until acted upon by an operator of the truck. Two linear potentiometers provide electrical output signals representing the X (horizontal) and Y (vertical) positions of the end of the shaft opposite the control handle. The cam is provided with four distinct compound surfaces. For vertical movement of the handle, the slopes of the two lower surfaces are greater than the slopes of the two upper surfaces. The slopes of each surface are also different in the forward and reverse direction. This arrangement provides the illusion that the same force is required to move the handle in any direction. A detent in the center of the cam requires a slightly greater force to move the handle from the center position.

15 Claims, 20 Drawing Sheets

MULTI-FUNCTION CONTROL HANDLE

CROSS-REFERENCE TO RELATED APPLICATIONS

This application claims the benefit of U.S. Provisional Application No. 60/053,722, filed Jul. 25, 1997 and entitled MULTI-FUNCTION CONTROL HANDLE; U.S Provisional Application No. 60/053,739, filed Jul. 25, 1997 and entitled MULTI-FUNCTION CONTROL HANDLE; and, U.S. Provisional Application No. 60/060,288, filed Sep. 29, 1997 and entitled MULTI-FUNCTION CONTROL HANDLE, all of which are incorporated herein by reference.

BACKGROUND OF THE INVENTION

The present invention relates in general to fork lift trucks and, more particularly, to the mounting of a multi-function control handle which is generally horizontally oriented so that the handle can be moved in any direction with approximately the same force, at least as perceived by an operator of a truck including the invention.

Control handles for several types of fork lift trucks are oriented vertically; however, on some trucks, for example rider reach trucks, the control handles are oriented generally horizontally. Typically, a horizontally orientated multi-function control handle includes an elongated body which is moved forward and backward to operate sensors and switches which control the direction and speed of travel of the truck, and upward and downward to operate sensors to control raising and lowering of forks of the truck. Additional control sensors and switches may be located at the end of the handle to control auxiliary functions of the truck, such as to control fork tilt, reach, and side shift. A horn button and selector switch may also be located at the end of the control handle. These auxiliary switches are usually manipulated by the operator's thumb and forefinger.

For durability and long life in the normally harsh operating environment in which fork lift trucks operate, the control handles must be of a sturdy construction. Such sturdy construction, together with the auxiliary control mechanisms, leads to a handle which has substantial weight. When the weight of the operator's hand is added to the weight of the control handle, conventionally supported control handles tend to be relatively easy to move downwardly due to the force of gravity. Prior art control handles include a variety of support arrangements to return the handles to neutral or center positions, oftentimes taking the form of spring biasing the handles so that when the handles are moved away from neutral positions springs are biased to return the handles to the center positions.

For control handles which are generally horizontally mounted, the conventional approach has been to increase the forces applied by springs biasing the handles to neutral positions. Unfortunately, such increased spring forces make it harder to move the handles upwardly as well as from side to side thus reducing the ease of moving the control handles and thereby reducing the ease of controlling trucks including the handles.

It is apparent that there is a need for an improved horizontally oriented control handle which can be moved in any direction with approximately the same force so that an operator of a truck including the handle can more easily and accurately control the handle and hence the truck including the handle.

SUMMARY OF THE INVENTION

This need is met by the invention of the present application wherein a generally horizontally oriented control handle is mounted so that it is easier to move than prior art devices and wherein operator perceived forces required to move the control handle are substantially the same in any direction. The invention includes a ramp cam against which a spring loaded cam follower member operates. The shape and slope of the ramp cam surface provides additional resistance to downward movement of the control handle to compensate for the effects of gravity on the control handle. With the improved control handle support or mounting mechanism of the present invention, the operator perceives that the same amount of force is required to move the handle up, down, forward, or reverse; however, in reality, there are at least four different forces required.

The ramp cam provides a home or neutral position for the control handle, requiring the operator to exert a positive force to move the handle from its neutral position in any direction, but no so much as to cause the operator to over-control. Additional configurations of the ramp cam, taking the form or vertical and/or horizontal slots, aid in moving the handle selectively in a vertical and/or horizontal plane. Thus, the control handle may be moved forward and backward to cause the truck to travel in the forward and reverse direction without any tendency to raise or lower the forks inadvertently and/or, the control handle can be moved up and down to raise or lower the forks without any tendency to cause the truck to move. Of course, the control handle can be moved in any direction at the operator's election so that the truck can be made to move in either direction while simultaneously raising or lowering the forks.

It is an object of the present invention to provide an improved control device to which a control handle can be secured, for use for example in a fork lift truck, wherein the control handle is mounted generally horizontally and can be moved in any direction using a perceived forced which is substantially the same regardless of the direction the handle is moved; to provide an improved control device for supporting a generally horizontally mounted control handle wherein a ramp cam is configured to counteract the force of gravity which normally makes movement of the handle in a downward direction require less force than movement of the handle in other directions; to provide an improved control device for supporting a generally horizontally mounted control handle wherein a ramp cam is configured to counteract the force of gravity which assists downward movement of the handle and is divided into quadrants to facilitate movement of the handle in a vertical and/or horizontal plane.

Other objects and advantages of the invention will be apparent from the following description, the accompanying drawings and the appended claims.

DETAILED DESCRIPTION OF THE INVENTION

Figure 1:
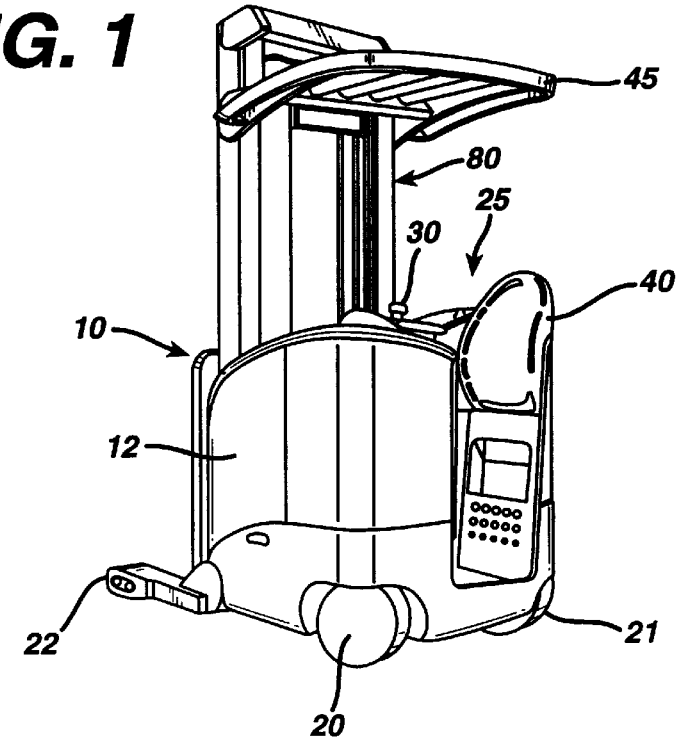
FIG. 1 is perspective view of a rider reach fork lift truck which includes a control handle supported by a control device in accordance with the present invention.

Reference is now made to the drawings which illustrate a preferred embodiment of the invention of the present application, and particularly to FIGS. 1 to 4 which show a rider reach fork lift truck 10 that includes a power unit 12 which houses a battery (not shown) for supplying power to a traction motor (not shown) connected to steerable a wheel 20 and to hydraulic motors (not shown) which supply power to several different systems. A caster wheel 21 is mounted at the right rear of the truck 10 while a pair of outriggers 22 are mounted at the forward part of the truck 10.

An operator's compartment 25 in the power unit 12 is provided with a steering tiller 30 for controlling the direction of travel of the truck 10, and a control handle 35 for controlling travel speed and direction (front/rear) as well as fork height, extension, tilt and side shift. An arm rest 37 supports the operator's right arm and includes an extension or arm 38 onto which a control device 100 of the present invention is mounted and which receives the control handle 35. A back rest or seat 40 supports the operator in the compartment 25. An overhead guard 45 is positioned above the operator's compartment 25.

A pair of forks 50 are mounted on a fork carriage mechanism 55 which is in turn mounted on a reach mechanism 60 on a vertical carriage assembly 70. As described in U.S. Pat. No. 5,586,620, which is incorporated herein by reference, the assembly 70 is attached to an extensible mast assembly 80, which includes a fixed, lower mast member 82 and nested movable mast members 84 and 86.

Figure 2:
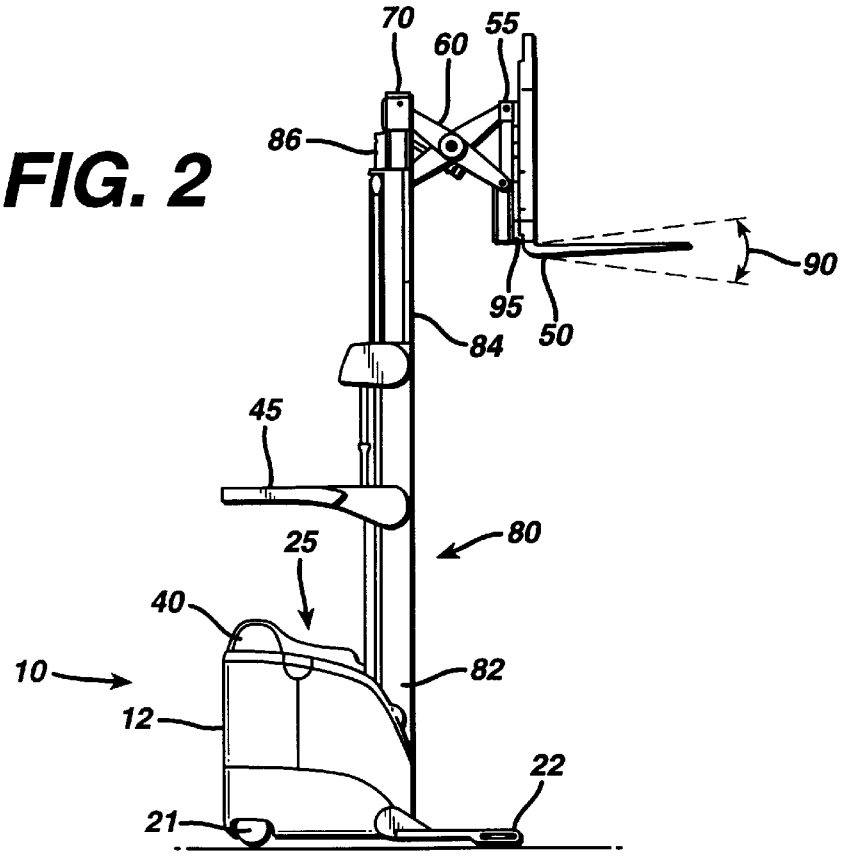
FIG. 2 is side view of a fork lift truck.
Figure 3:
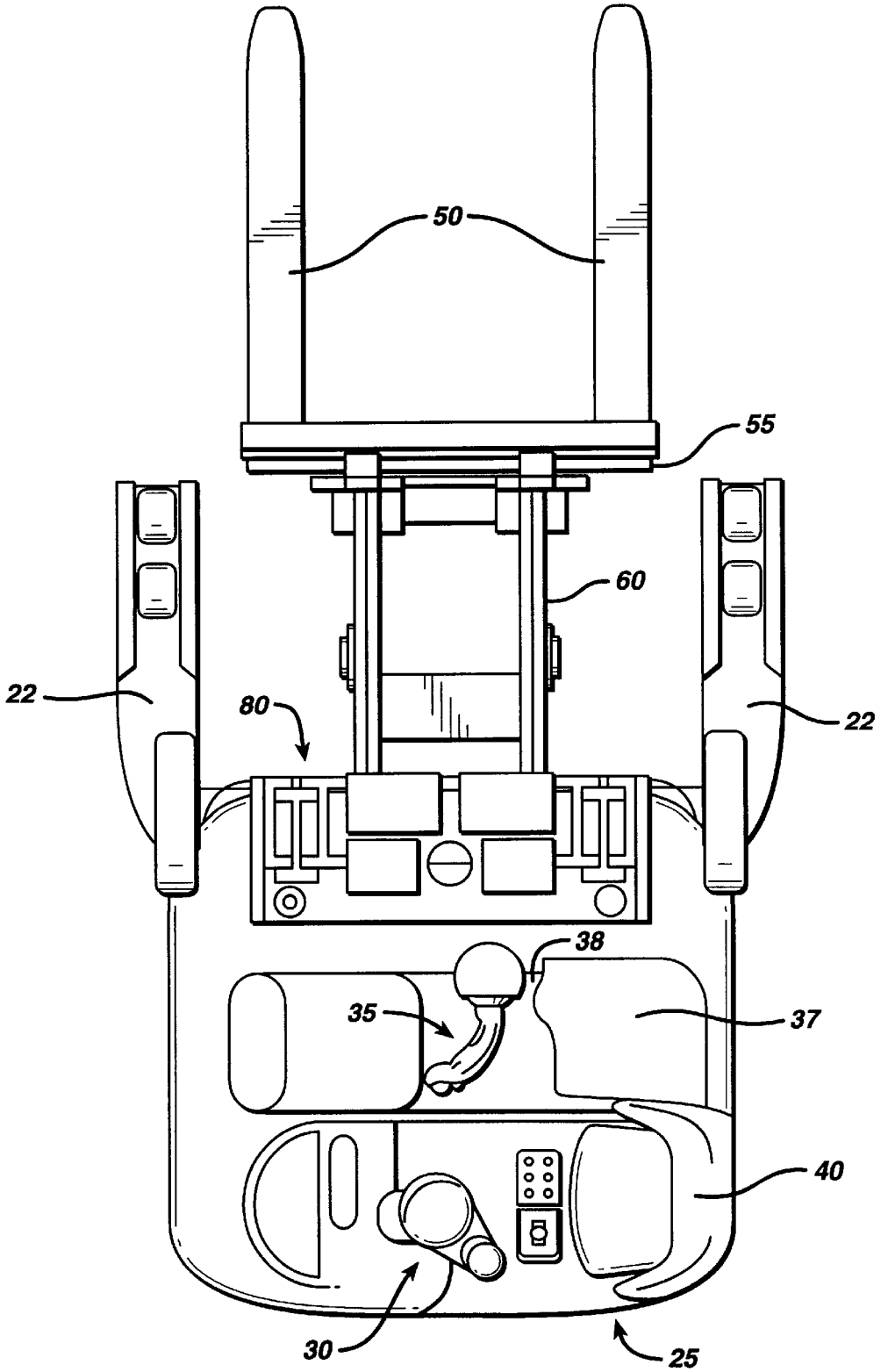
FIG. 3 is a plan view of a fork lift truck showing an operator's compartment including a control handle and a steering tiller.
Figure 4:
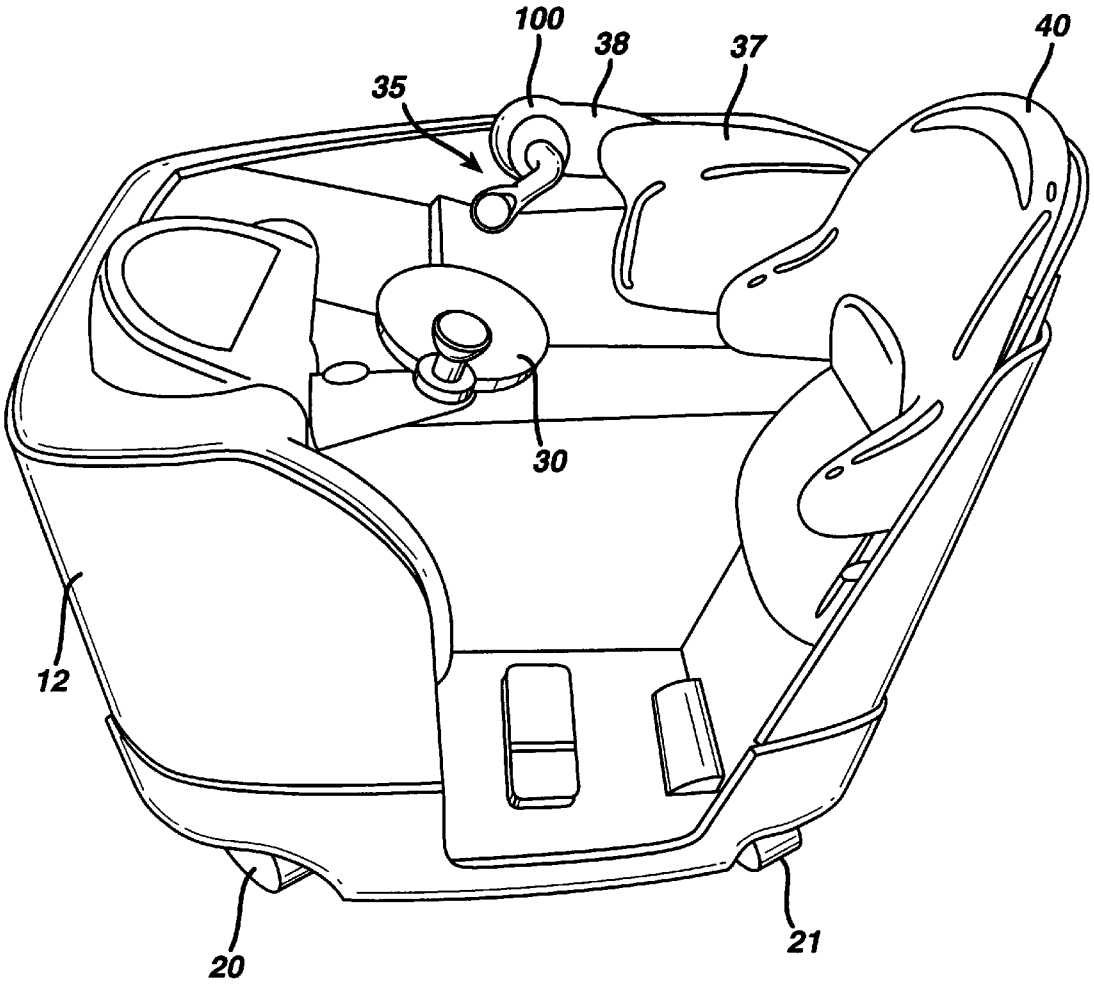
FIG. 4 is a perspective view of an operator's compartment of a fork lift truck.

A hydraulic cylinder (not shown) is operated by control handle 35 to control the height of the forks 50 which are shown raised in FIG. 2. The forks 50 may be tilted through a range shown by the arrow 90 by means of a hydraulic cylinder 95 located between the forks 50 and the fork carriage mechanism 55. The forks may also be moved from side to side by a side shift mechanism (not shown).

Figure 5:
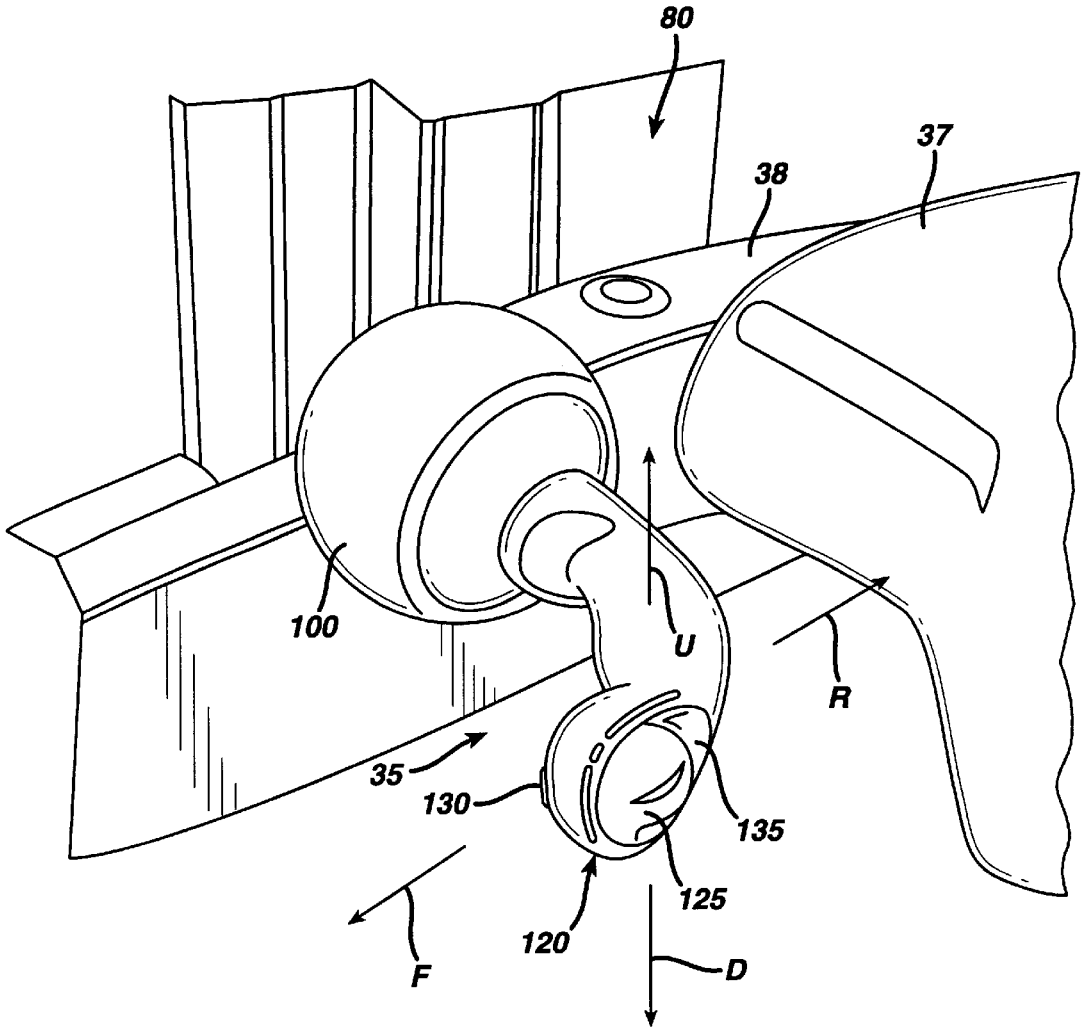
FIG. 5 is a perspective view of a control handle supported by the control device of the present invention, the control handle extends into the operator's compartment and is positioned to be received by the operator's right hand.
Figure 6:
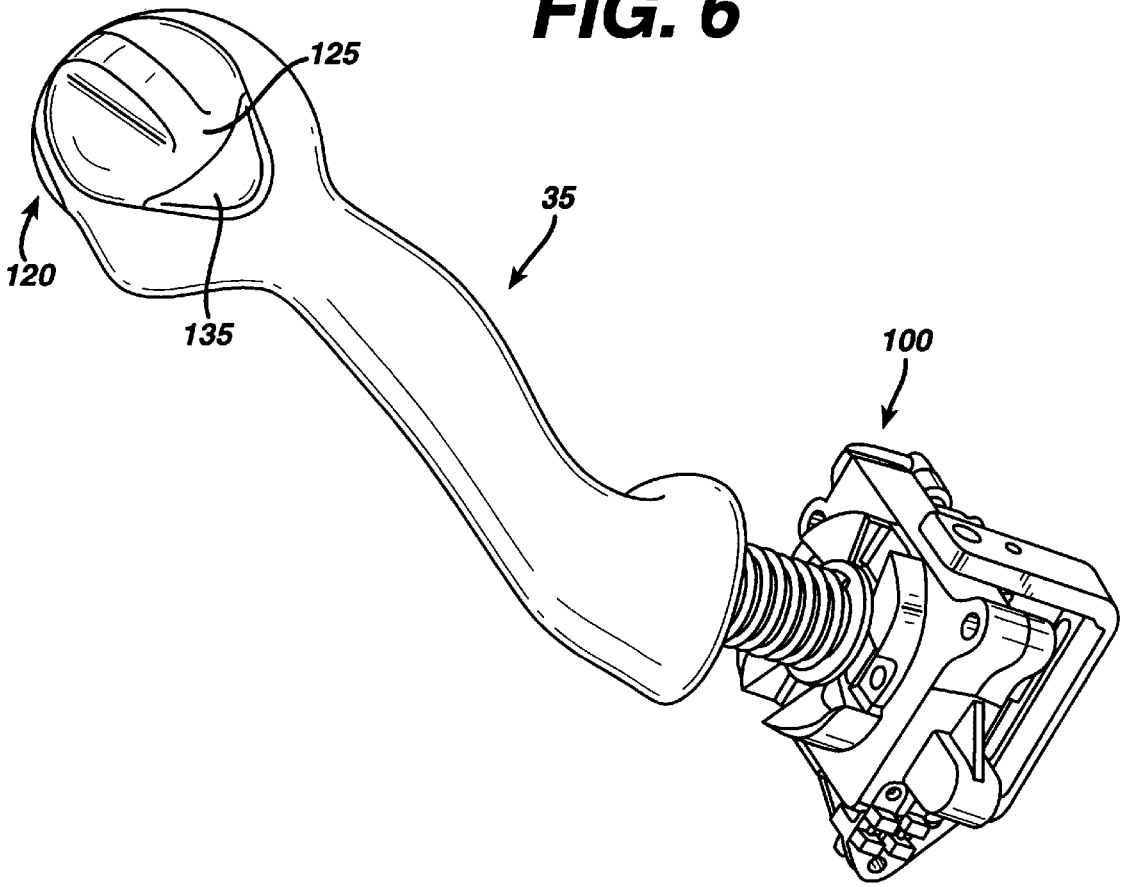
FIG. 6 is perspective view showing the control handle of FIGS. 1–5 attached to the control device of the present invention.
Figure 7:
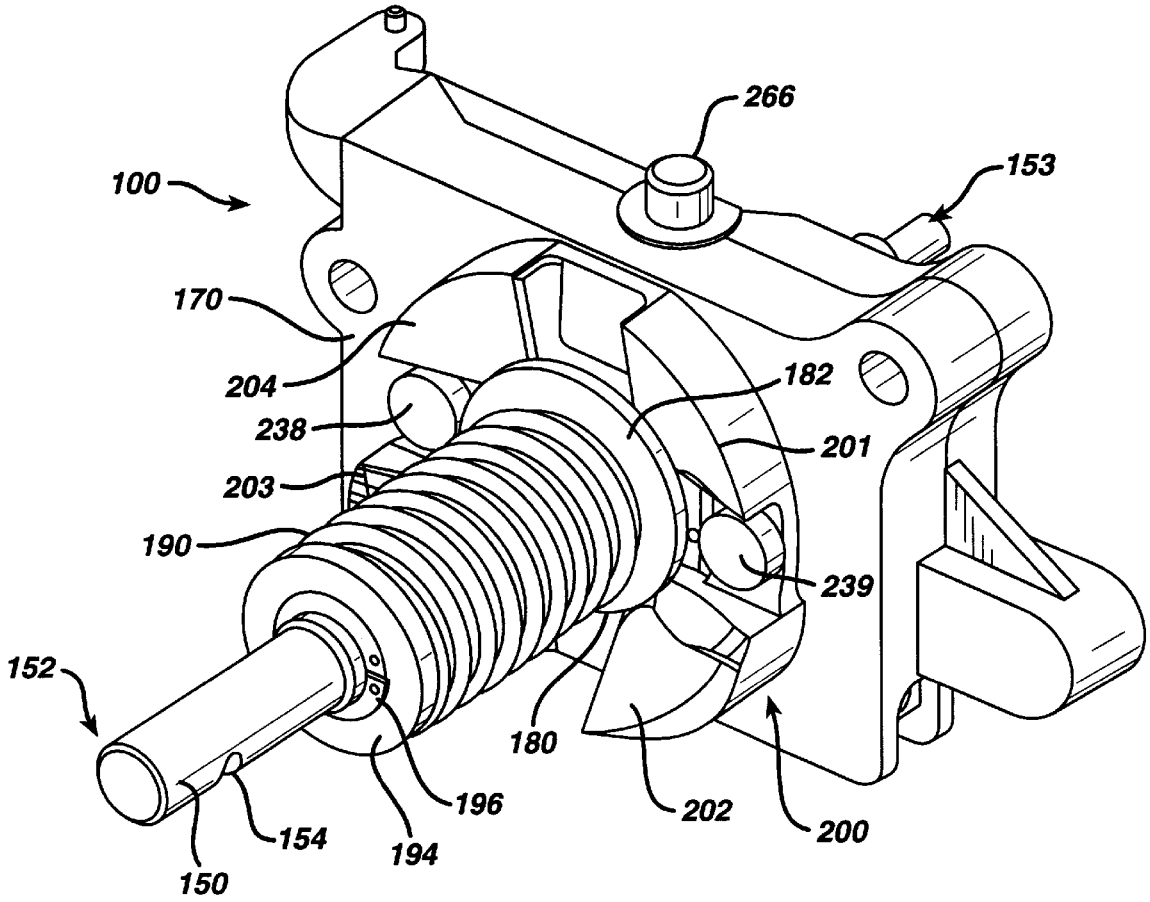
FIG. 7 is front perspective view of the control device of the present invention.

Referring to FIG. 5, the control handle 35 is mounted on the control device 100. Movement of the truck 10 in the forward and reverse directions is accomplished by the operator pushing the handle 35 forward or pulling it back, respectively. Thus, if the handle 35 is pushed forward in the direction of arrow F, the truck 10 will move forward; if the handle is moved rearward in the direction of arrow R, the truck 10 will move in the reverse direction. Similarly, raising and lowering the forks is accomplished by moving the handle up in the direction of arrow U and down in the direction of arrow D.

Other functions of the truck 10 are controlled by an auxiliary switch mechanism 120 located at the end of the handle 35 which switch mechanism 120 may be operated by the fingers and thumbs of the operator. As shown in FIG. 5, the auxiliary switch mechanism 120 includes a thumb operated knob switch 125 which, when moved in upwardly causes the forks 50 to tilt upward, and when moved in the opposite direction causes the forks 50 to tilt downward. When the switch 125 is moved in the direction of arrow F, the forks 50 will be moved (or reach) outwardly, away from the mast, and when moved in the direction R, the forks 50 will be moved inwardly or retracted toward the mast. A side shift selection switch 130, when depressed by the finger of the operator, changes the function of the switch so that movement of the knob 125 in the direction of arrows F and R will cause the forks to move from side to side, to the left and right, respectively. A horn button 135 is placed on the handle 35 to be actuated by the operator's thumb.

The control device 100, shown in FIGS. 6–13 and 31, includes a shaft 150 mounted for pivotal movement in a support member 170. The shaft 150 includes a first or outward end 152 which extends into the control handle, an inward end 153 that controls shaft position sensors, a retaining slot 154 for securing the control handle 35 to the shaft 150, and a spherical section 160.

Figure 10:
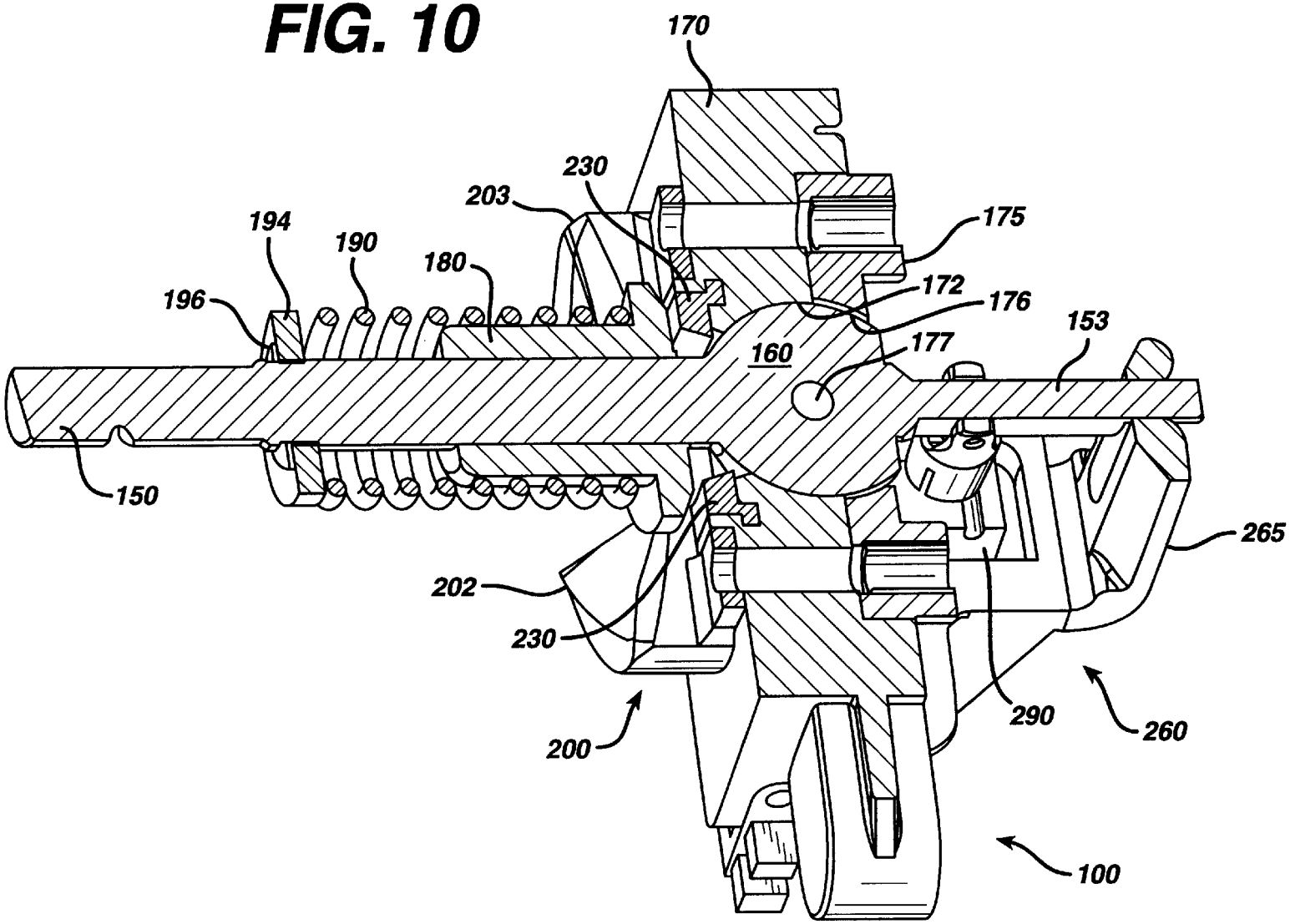
FIG. 10 is cross sectional view taken along section line 10—10 of FIG. 9 showing the bottom half of the control mechanism of FIG. 9.
Figure 11:
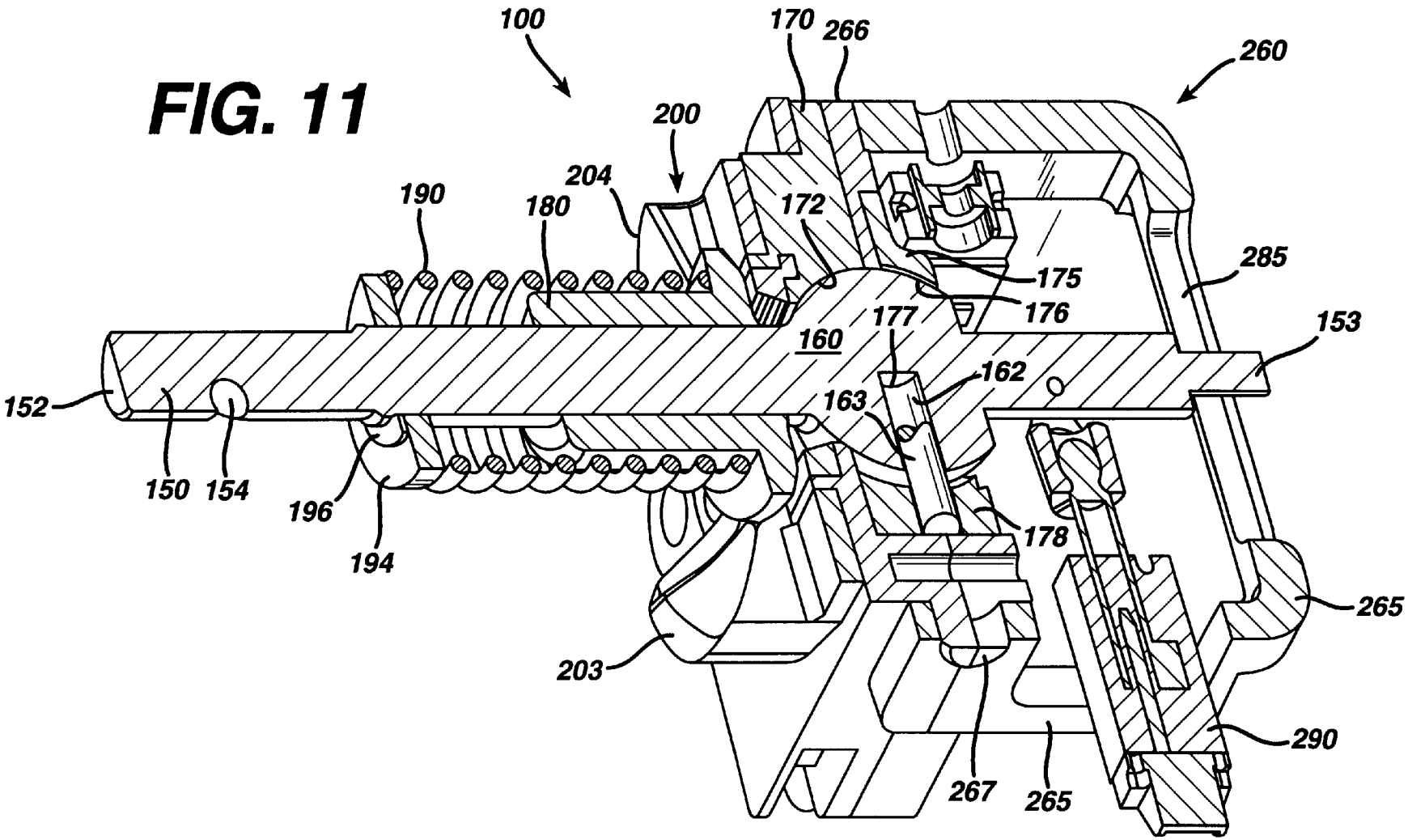
FIG. 11 is cross sectional view taken along section line 11—11 of FIG. 9 showing the left half of the control mechanism of FIG. 9.

The support member 170 is provided with a socket 172 for receiving the spherical section 160 of the shaft, thereby forming a ball and socket pivot or hinge assembly, see FIGS. 10 and 11. A retaining plate 175, also provided with a socket 176, captures the spherical section 160 of the shaft 150 and holds it in place while allowing the shaft 150 to rotate about a center 177 of the spherical section 160.

Rotation of the shaft 150 about its own longitudinal axis is prevented by a pin 163 that extends in the horizontal plane into an opening 162 formed along an axis of rotation of the spherical section 160; the outer end of the pin 162 extends into a slot 178 formed in the support member 170 which allows for rotation in a vertical plane, see FIG. 11.

Figure 14:
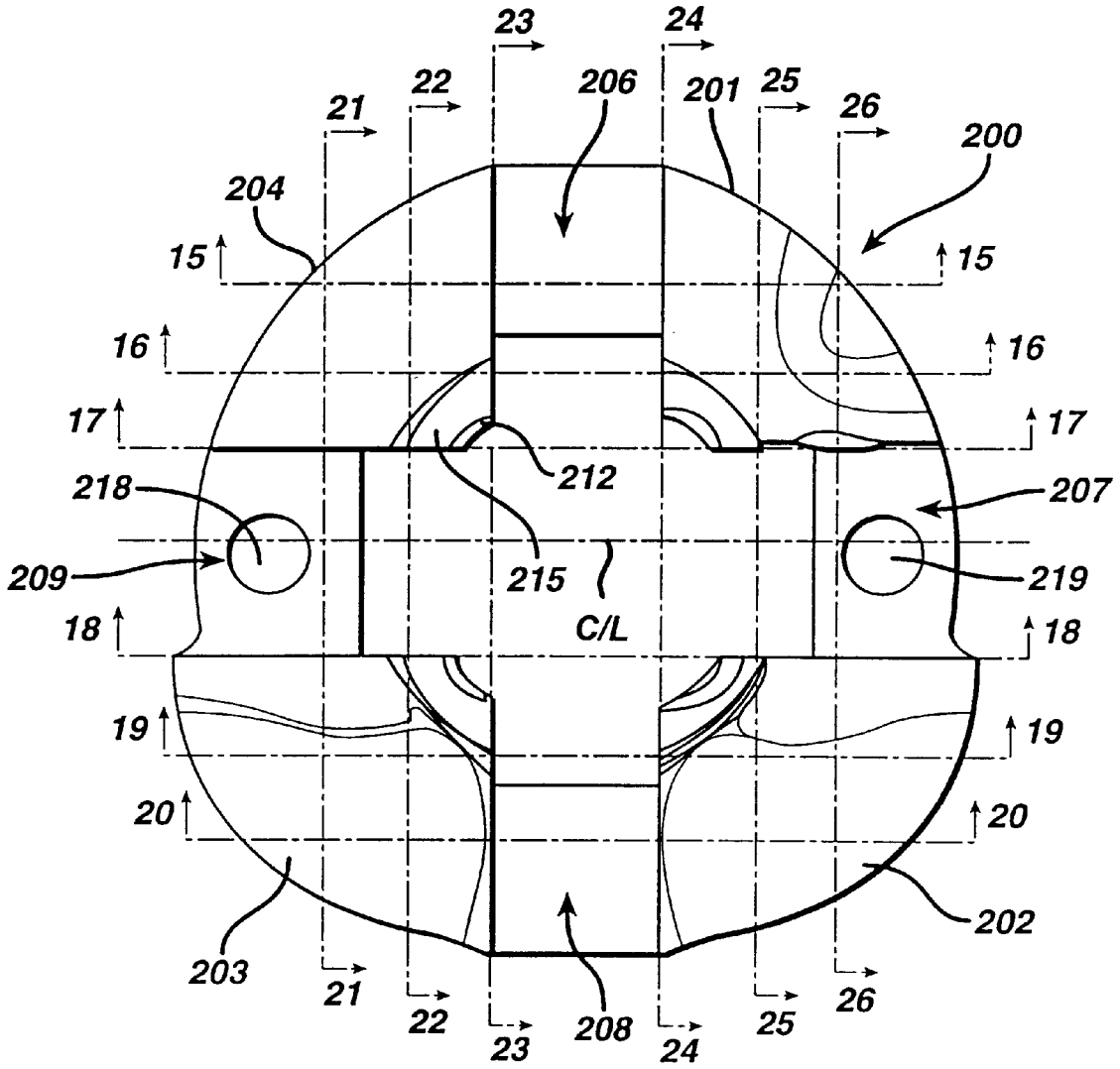
FIG. 14 is a plan view of the ramp cam.
Figure 15:
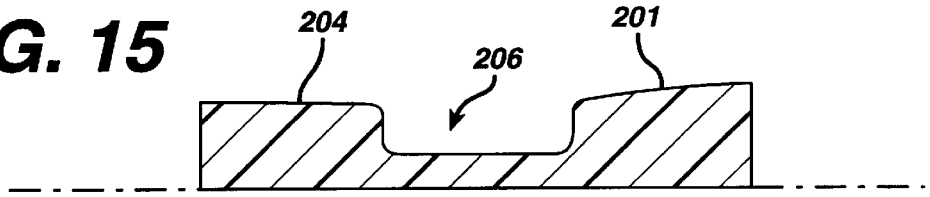
FIGS. 15–20 are cross sectional views of the ramp cam of FIG. 14 taken along lines 15 through 20 of FIG. 14.
Figure 16:
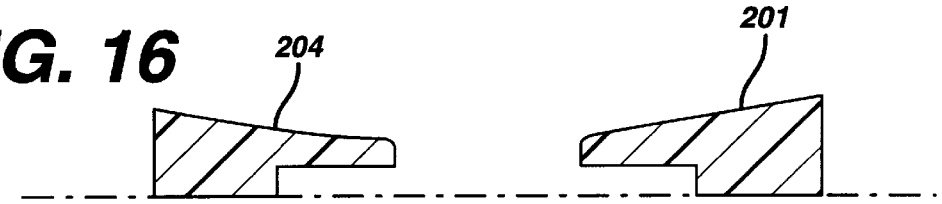
Figure 17:
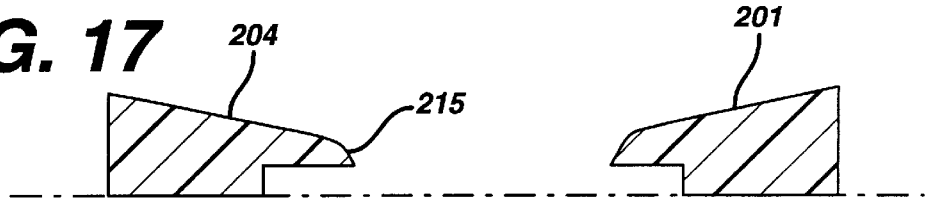
Figure 18:
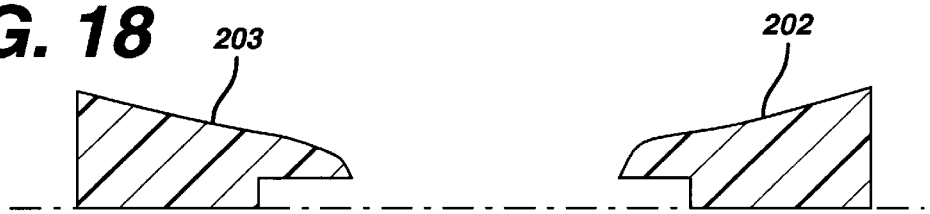
Figure 19:
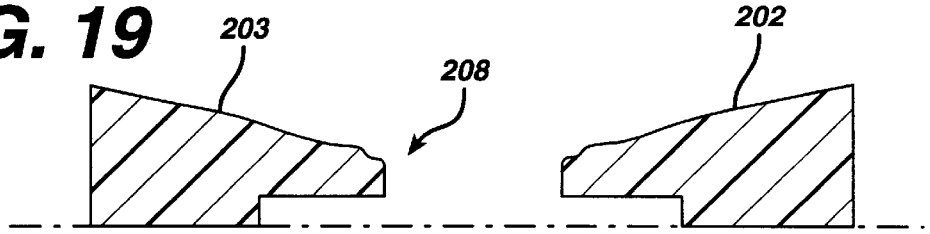
Figure 20:
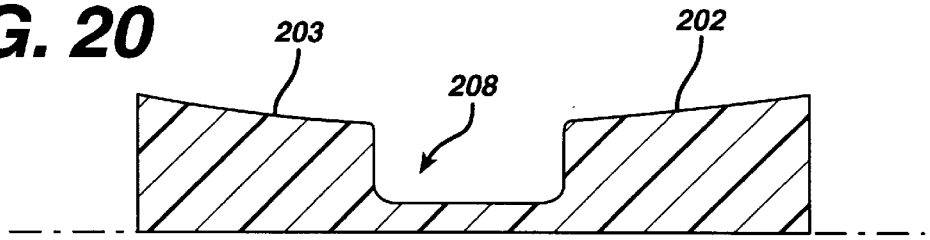
Figure 21:
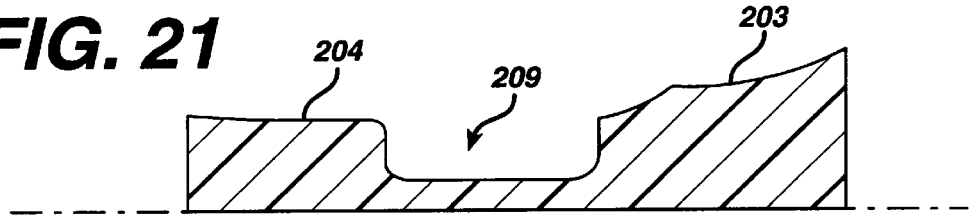
FIGS. 21–26 are cross sectional views of the ramp cam of FIG. 14 taken along lines 21 through 26 of FIG. 14.
Figure 22:
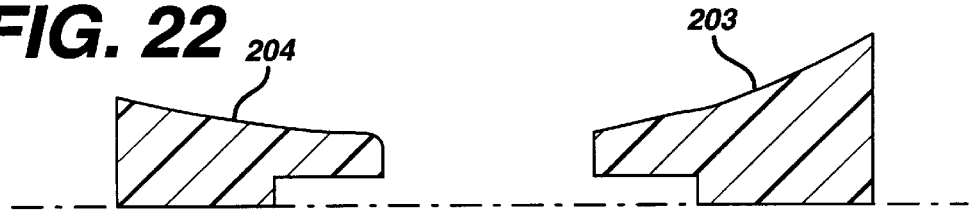
Figure 23:
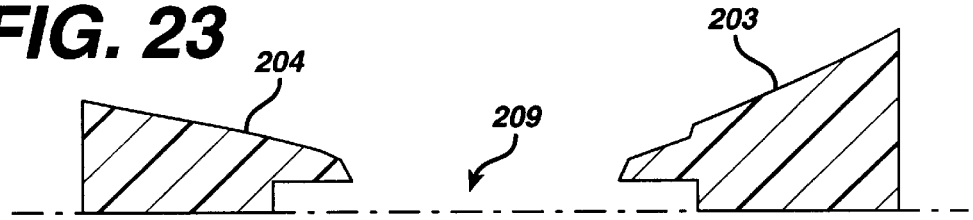
Figure 24:
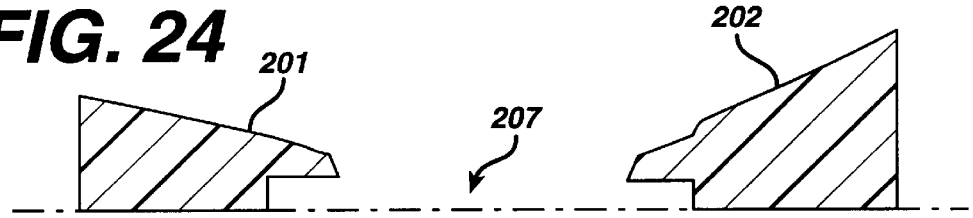
Figure 25:
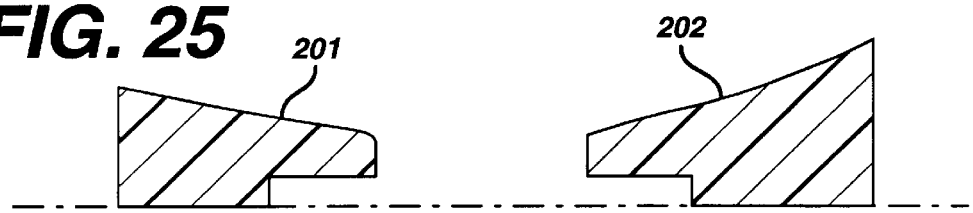
Figure 26:
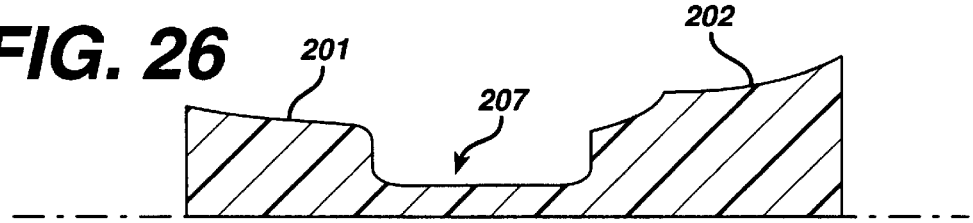
Figure 27:
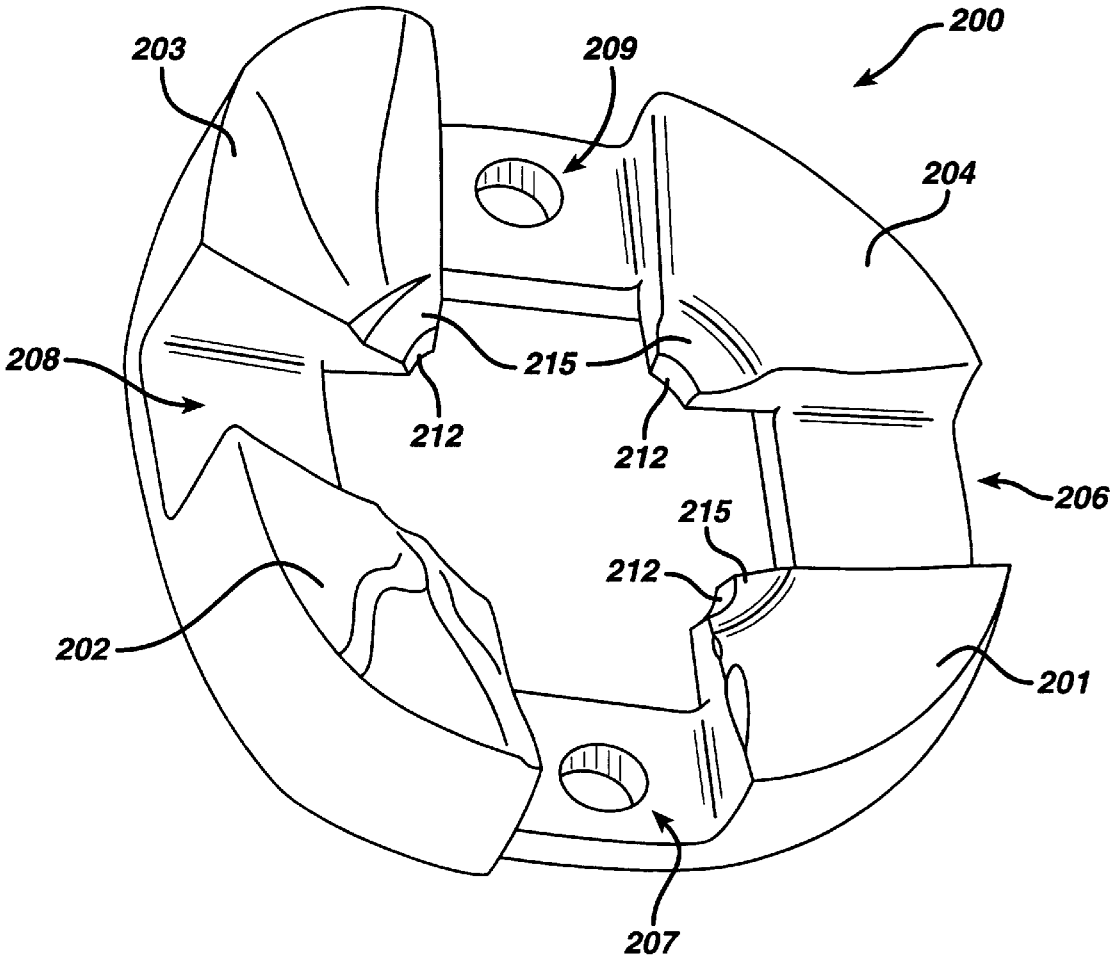
FIGS. 27 and 28 are perspective views of the ramp cam or bearing surface.
Figure 28:
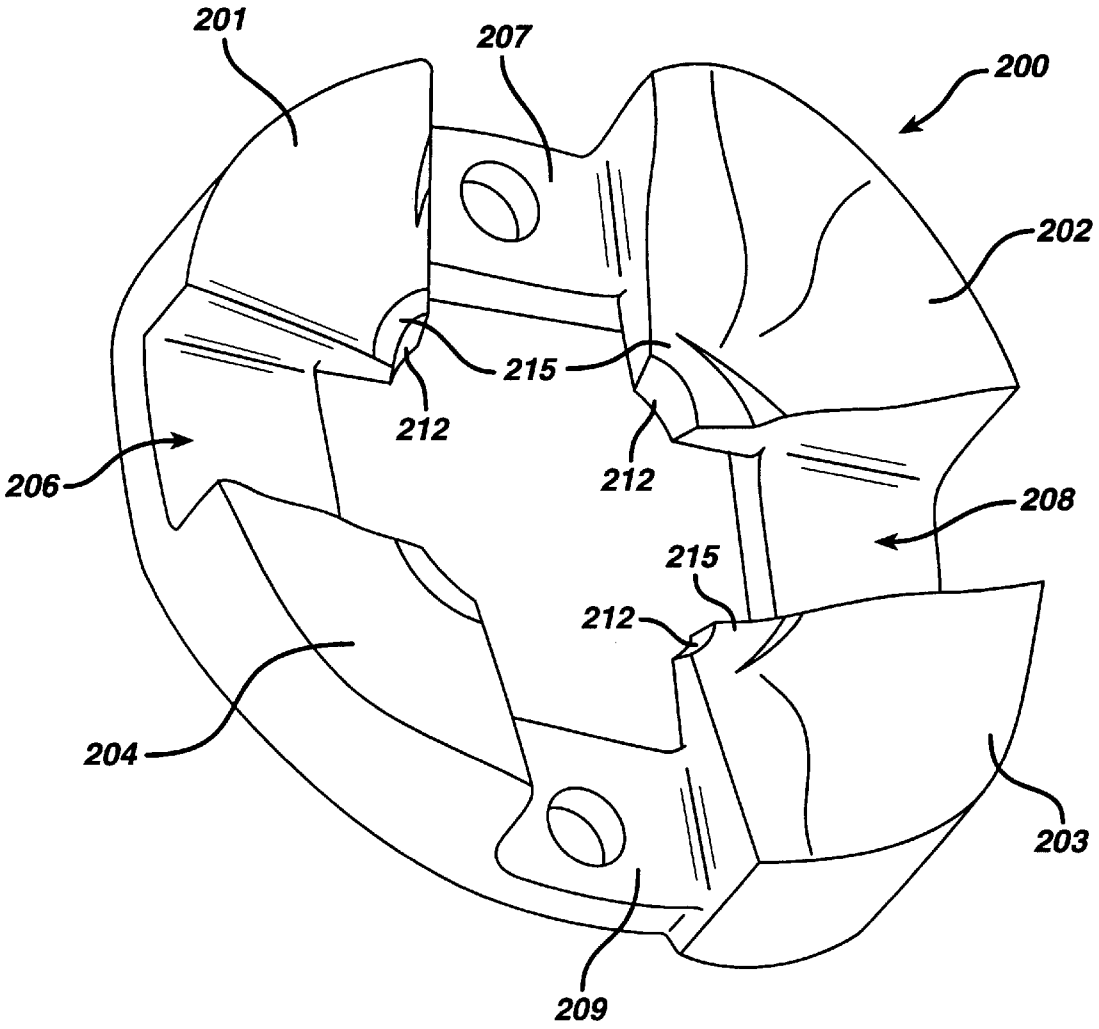

Free movement of the shaft 150 about the center 177 of the spherical section 160 of the shaft 150 is opposed by a spring biasing mechanism or cam follower that includes a slider 180 which is mounted coaxially with and surrounds the shaft 150, a spring 190, a spring retainer taking the form of a washer 194 in the illustrated embodiment, and a ramp cam 200. The slider 180 includes a cylindrical body 182 provided with a flange 184 at the end facing the cam 200. A frusto-conical cam contacting or bearing surface 186 is formed on the outside of the flange 184 and engages the ramp cam 200, see FIGS. 12 and 13. The spring 190 is compressed between the flange 184 of the slider 180 and the washer 194 or retainer which is held in place by a snap ring 196 that fits into a slot on the shaft 150. To counteract the force of gravity on the control handle 35, the ramp cam 200 has a general first slope below a centerline C/L and a general second slope above the centerline C/L with the second slope being less than the first slope, see FIG. 14.

While the ramp cam 200 can be formed on the support member 170, as illustrated, it is separately formed and then attached to the support member 170. In the illustrated embodiment, the ramp cam 200, shown in detail in the FIG. 14–28, includes four specially shaped bearing surfaces 201–204 or ramps. Four slots 206–209, formed in the ramp cam 200, separate the bearing surfaces from one another. Thus, the slot 206 is located between the bearing surfaces 201 and 204, the slot 207 is located between the bearing surfaces 201 and 202, the slot 208 is located between the bearing surfaces 202 and 203, and the slot 209 is located between the bearing surfaces 203 and 204. The four slots 206, 209 can be envisioned as comprising a horizontal slot made up of the slots 207, 209 and a vertical slot made up of the slots 206, 208. Each of the bearing surfaces 201–204 of the ramp cam 200 includes a relieved area 212 which accommodates the shaft 150 when the shaft 150 is moved to its limit position in any direction.

Each bearing surface, or ramp, includes two different ramp configurations on which the bearing surface 186 of the slider 180 rides. The first ramp configuration defines a third slope which provides a centering function and requires the operator to exert a positive force to move the shaft 150 from its neutral or center position as shown in FIGS. 7–11. In other words, the first ramp configuration provides a detent. In FIGS. 14–28, the first ramp configuration is shown as a ramp 215. The diameter of the outer edges of the ramps 215 correspond generally to the diameter of the flange 184. The complex shape of the ramp cam 200 as illustrated in FIGS. 14–28 is empirically determined to provide the desired feel when an operator uses the control handle 35.

Each bearing surface also includes a second ramp configuration which is tailored to specific needs. Thus, the second ramp configuration of the two lower ramps 202 and 203 located below the centerline C/L has a first slope which is greater than a second slope of the second ramp configuration of the two upper ramps 201, 204. For this configuration, more force must be exerted against the control handle 35 by the operator when moving the control handle 35 down than when moving the control handle 35 up, although the forces are perceived by the operator to be approximately equal. Also, the slopes of the second ramps vary from front to rear. Further, the overall topography of each of the second ramps is unique and varies across its surface in order to accomplish the desired purpose of providing the operator with a feel or perception that equal effort is required to move the handle 35, once it has been moved from its center position. The slopes of the surfaces at various locations on the ramp cam 200 are shown in FIGS. 14–28.

The handle 35 can be moved forward and backward in a horizontal plane aligned with the slots 207, 209 to cause the truck 10 to travel in the forward and reverse directions, respectively, without any tendency to raise or lower the forks 50 inadvertently. Similarly, the handle 35 can be moved up and down in a vertical plane aligned with the slots 206, 208 to cause the forks to raise or lower, respectively, without any tendency to cause the truck 10 to move. Of course, the control handle 35 can be moved in any direction at the operator's election so that the truck 10 can be made to move in either direction while simultaneously raising or lowering the forks 50. This stability of movement in either a horizontal plane or a vertical plane is provide by having two points of the frusto-conical cam contacting or bearing surface 186 formed on the outside of the flange 184 of the slider 180 make contact with the slots 206–209 during such movement. Thus, the bearing surface 186 makes two point contact with the slots 207, 209 for horizontal movement of the control handle 35 and the bearing surface 186 makes two point contact with the slots 206, 208 for vertical movement of the control handle 35. For movements in other than the horizontal and vertical planes defined by the slots 206–209, the bearing surface 186 makes only one point contact.

The shaft 150 extends through a limiter plate 230, shown in FIGS. 10, 11, 29 and 30. The opening 231 in the limiter plate is curved to define the limits of movement of the shaft 150 when the handle 35 is moved to its extreme positions. In particular, the limiter plate is 230 curved to guide the handle 35 in a non-linear path whenever the handle is pushed or pulled to its limit in either the forward or reverse direction and then moved up or down to raise or lower the forks. The reason for this configuration is to assure linear actuation of the shaft position sensing devices 260, which will be described later.

Figure 9:
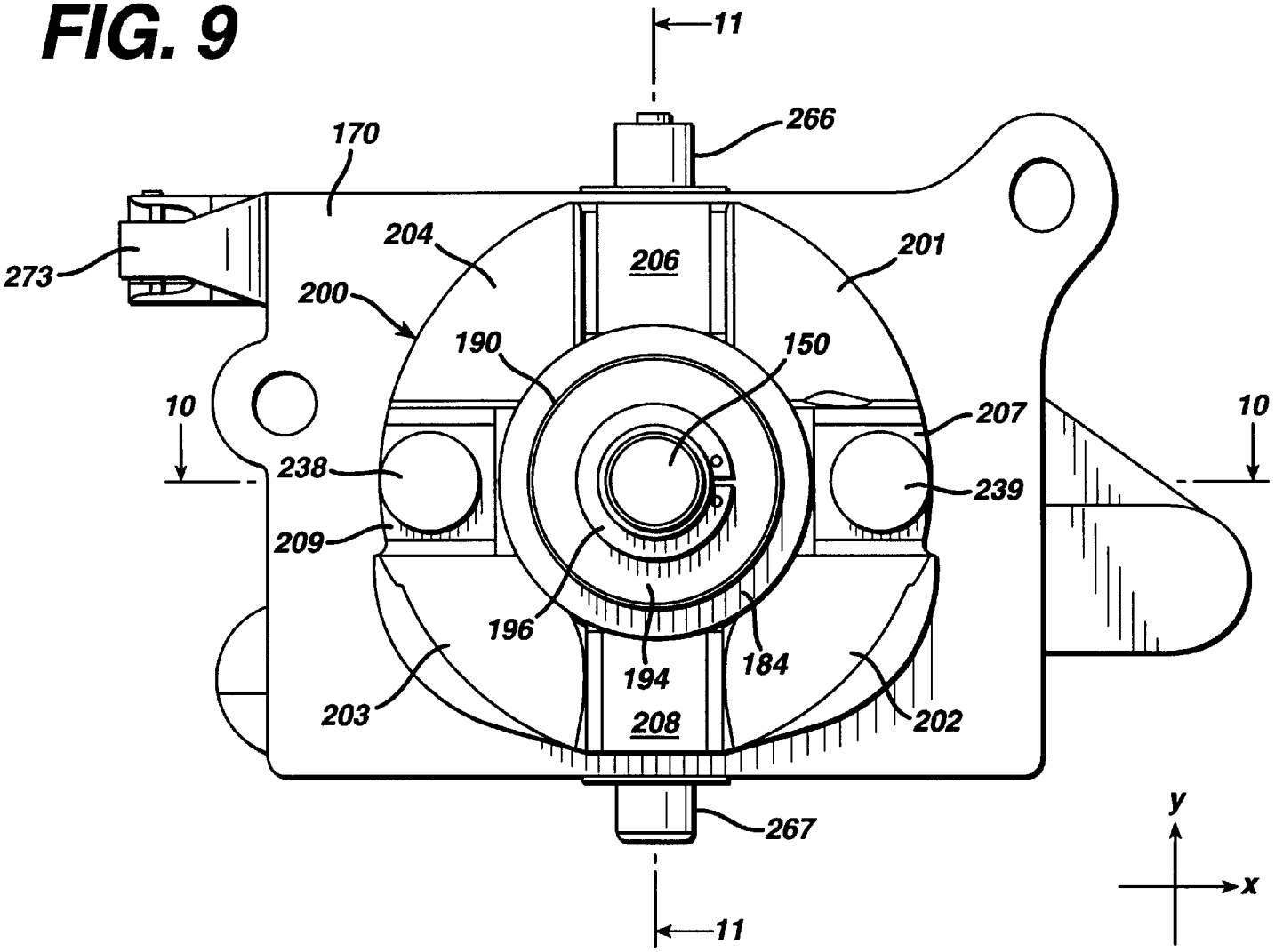
FIG. 9 is front elevational view of the control device of FIG. 8.
Figure 29:
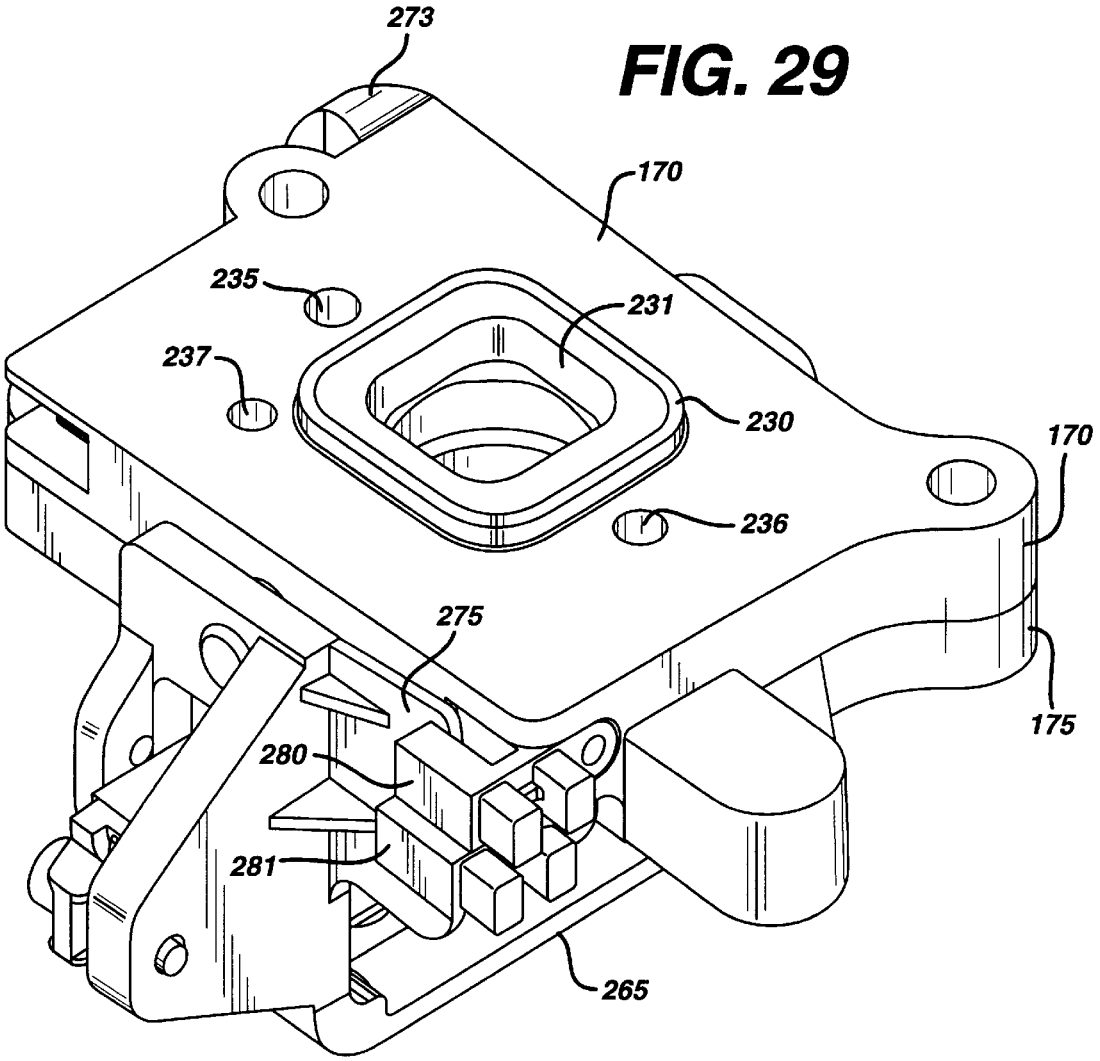
FIG. 29 is a front perspective view of a support member of the control device showing a motion limiter plate.
Figure 30:
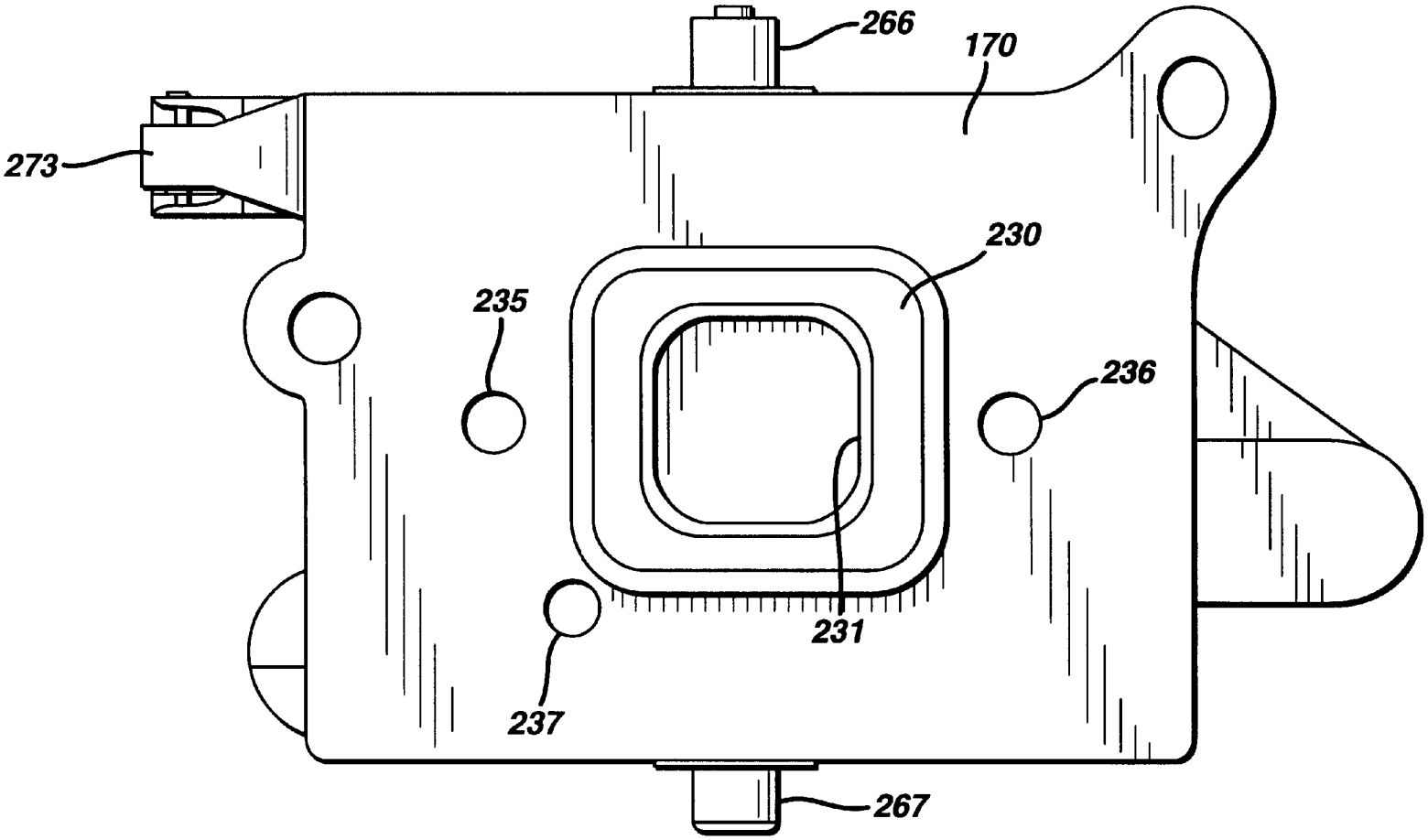
FIG. 30 is front view of a support member of the control device showing the limiter plate.
Figure 31:
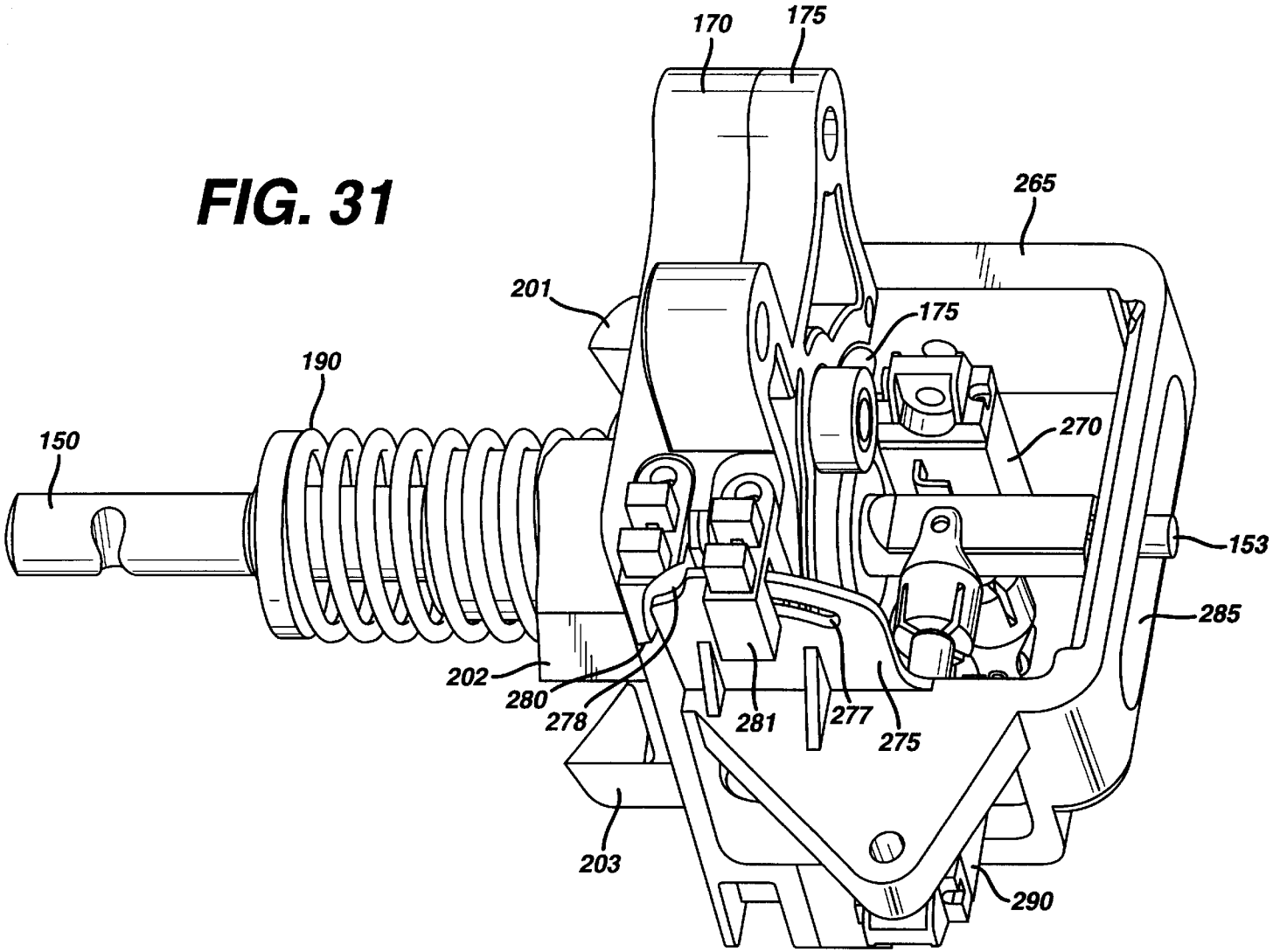
FIG. 31 is a perspective view of the control device showing a shaft position sensing mechanism attached thereto.

Also shown in FIGS. 29 and 30 are two openings 235, 236 which receive fasteners 238 and 239, shown in FIG. 9, that extend through openings 218 and 219 in the ramp cam 200 for attaching the ramp cam 200 to the support member 170. A third opening 237 receives an alignment pin (not shown) which protrudes from the back surface of the ramp cam 200, thus assuring that the ramp cam 200 will be properly aligned when attached during assembly.

The X, Y or horizontal and vertical position of the shaft 150, or the handle 35, is converted into an electrical signal by a shaft position sensing device 260. In this invention, the device 260 includes two linear potentiometers 270 and 290 to provide horizontal and vertical position signals, respectively, see FIGS. 12 and 13.

Figure 8:
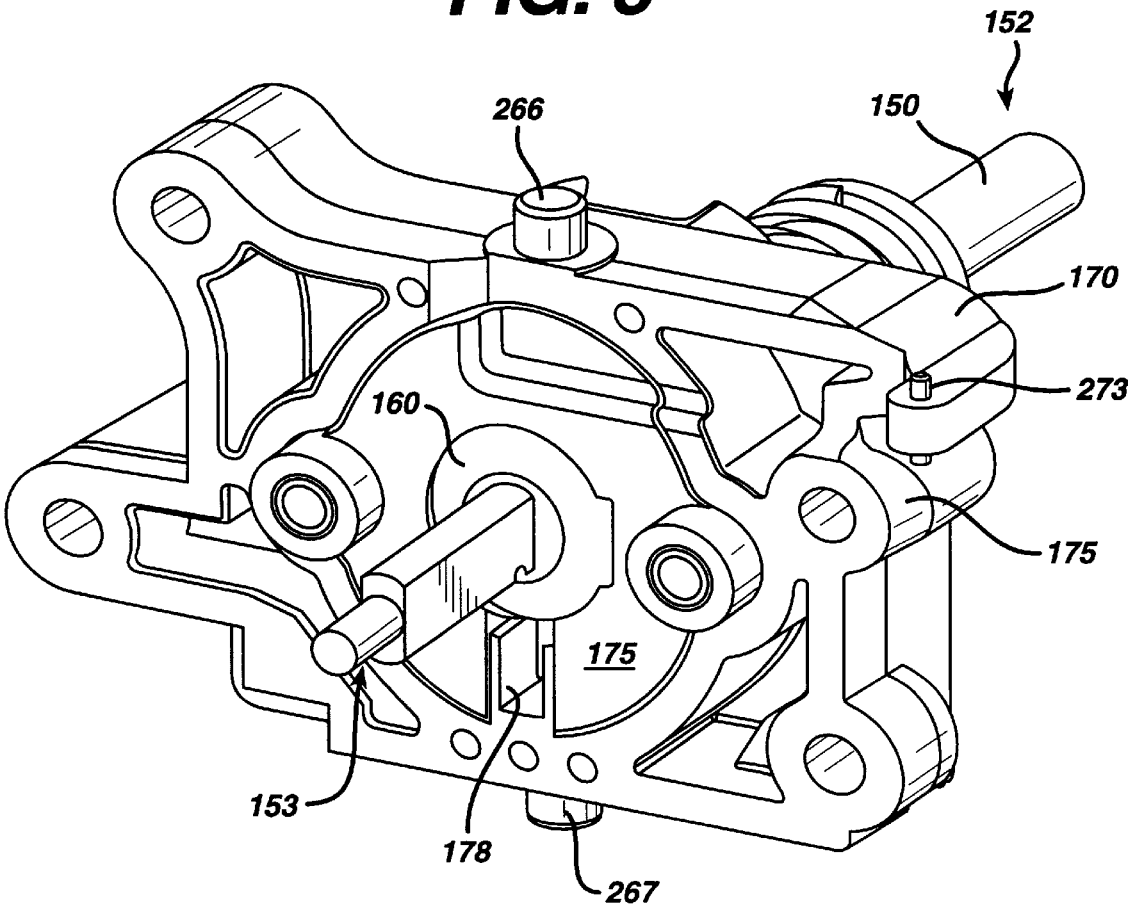
FIG. 8 is rear perspective view of the control device of FIG. 8.
Figure 12:
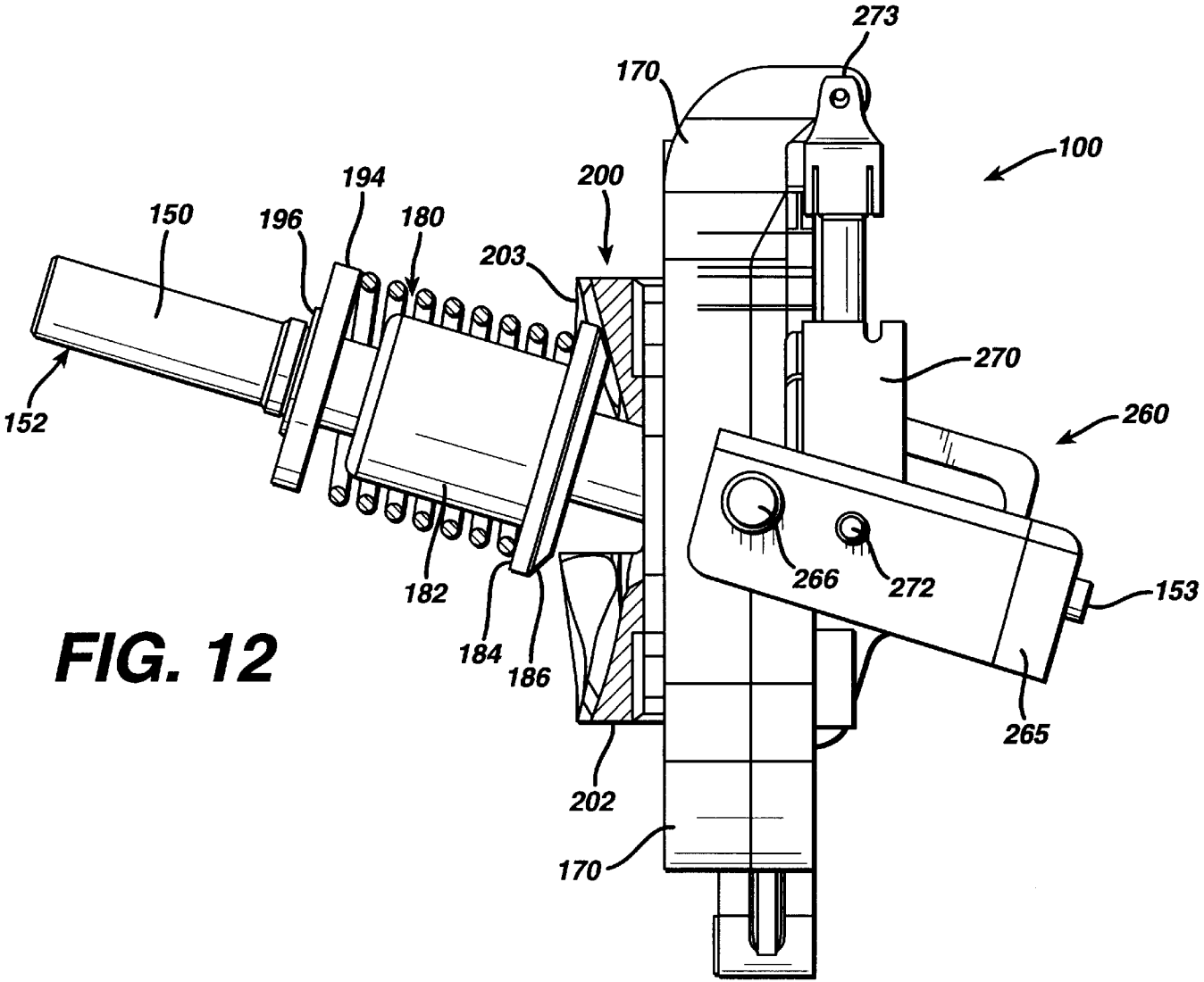
FIG. 12 is a top view of the control device of FIG. 9 positioned as it would be if an attached control handle was moved to the full forward position, with a ramp cam and spring shown in cross section.
Figure 13:
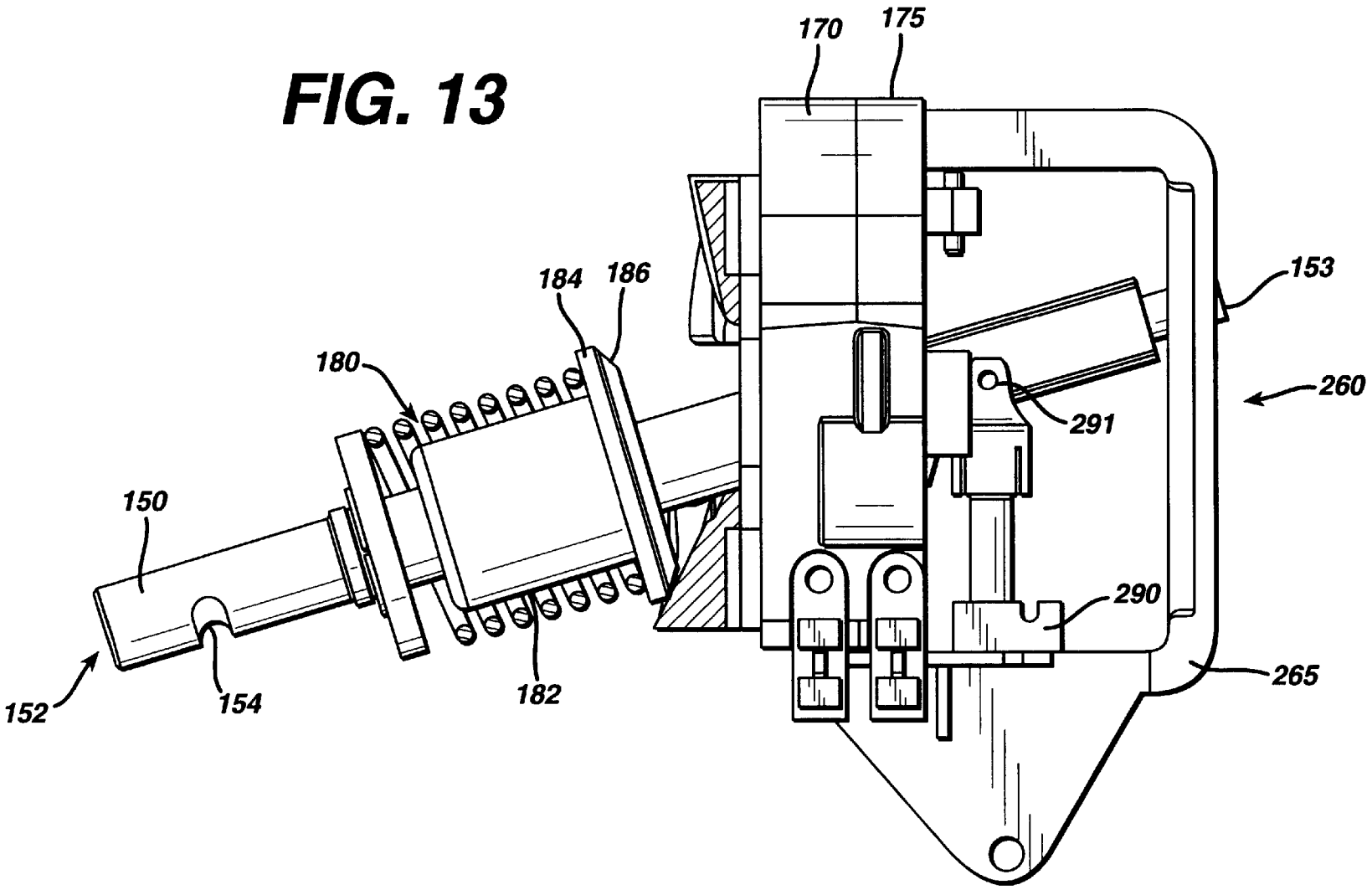
FIG. 13 is side view of the control device of FIG. 9 positioned as it would be if an attached handle was moved to the full lowered position, with the ramp cam and spring shown in cross section.

The position sensing device 260 includes a bracket 265 which is pivotally attached by pins 266 and 267 that extend from the top and bottom of support member 170. As the control handle 35 is moved in the horizontal direction, the bracket 265 will rotate about the pivot points defined by the pins 266 and 267, as shown in FIGS. 8, 9 and 12. A linear potentiometer 270 has one end connected to the bracket 265 at 272 and its other end attached to the support member 170 at 273. Thus, the position of the shaft 150, and the control handle 35, is determined by the output of the linear potentiometer 270. The bracket 265 also carries a bracket 275 which includes a pair of slots 277, 278, see FIG. 31. The slots 277, 278 pass over optical sensors 280 and 281 to provide an indication separate from the linear potentiometer 270 and indicate when the shaft 150, and hence the handle 35, is in its neutral position.

The end 153 of the shaft 150 extends through a slot 285 in the bracket 265 which allows the shaft 150 to move vertically with respect to the bracket 265. A second linear potentiometer 290 is attached to the shaft 150 at one end 291 and to the bracket 265 at the other end to provide an output proportional to the location of the shaft 150.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. A control device for supporting a control handle in a generally horizontal orientation, said control device comprising:

a support member;

a ramp cam on said support member;

a shaft for receiving said control handle and being pivotally mounted in said support member for free but limited movement;

a slider mounted coaxially with said shaft, said slider including a flange and a frusto-conical bearing surface;

a retainer on said shaft; and a spring surrounding said shaft and extending between said flange and said retainer for urging said frusto-conical bearing surface into contact with said ramp cam;

said ramp cam defining a bearing surface which is contoured to provide an operator using said control handle with the perception that equal effort is required to move said handle in any direction.

2. A control device as claimed in claim 1 wherein ramp cam is mounted on said support member.

3. A control device as claimed in claim 1 wherein said ramp cam is configured to have a first slope below a centerline thereof and a second slope less than said first slope above said centerline.

4. A control device as claimed in claim 3 wherein said ramp cam defines a third slope for defining a neutral, center position for said shaft.

5. A control device as claimed in claim 1 wherein said ramp cam is divided into four quadrants forming four bearing surfaces defined by a horizontal slot and a vertical slot formed into said ramp cam, said horizontal slot and said vertical slot being generally centered on said ramp cam to define a favored back and forth path for movement of said shaft in a horizontal plane and a favored up and down path for said shaft in a vertical plane, respectively.

6. A control device as claimed in claim 5 wherein said ramp cam has a greater slope in two lower quadrants of said four quadrants to compensate for the effects of gravity on said handle and said operator's hand.

7. A control device as claimed in claim 1 wherein said ramp cam has two distinct slope configurations, a first one of said two distinct slope configurations determining when said handle is in a center position and requiring a greater force to overcome than when said handle has been moved from said center position.

8. A control device as claimed in claim 7 wherein said a second one of said two distinct slope configurations is divided by a centerline of said ramp cam and comprises a first slope below said centerline and a second slope less than said first slope above said centerline.

9. A control device for supporting a control handle in a generally horizontal orientation, said control device comprising:

a support member;

a shaft mounted for pivotal movement in said support member, said shaft having a first end extending generally horizontally out a first side of said support member for receiving said handle;

a generally vertically oriented annular ramp cam on said support member, said first end of said shaft extending through said annular ramp cam;

a cam follower associated with said first end of said shaft and being spring biased into engagement with said ramp cam, said ramp cam defining a bearing surface contoured to provide an operator using a handle coupled to said control device with the perception that equal effort is required to move said handle in either direction in the horizontal plane or in either direction in the vertical plane.

10. A control device as claimed in claim 9 wherein said ramp cam is mounted on said support member.

11. A control device as claimed in claim 9 wherein said cam follower comprises:

a slider surrounding said shaft and having a flange defining a frusto-conical ramp cam contacting surface; and a spring supported by and surrounding said shaft for forcing said ramp cam contacting surface into contact with said ramp cam.

12. A control device as claimed in claim 9 wherein said ramp cam bearing surface is configured to have a first slope below a centerline thereof and a second slope less than said first slope above said centerline.

13. A control device as claimed in claim 12 wherein said ramp cam defines a third slope for defining a neutral, center position for said shaft.

14. A control device as claimed in claim 9 wherein said ramp cam is divided into four bearing surfaces defined by a horizontal slot and a vertical slot formed into said ramp cam, said horizontal slot and said vertical slot being generally centered on said ramp cam to define a favored back and forth path for said shaft and a favored up and down path for said ramp cam, respectively.

15. A control device as claimed in claim 14 wherein said four bearing surfaces of said ramp cam define a third slope for defining a neutral, center position for said shaft.

* * * * *